US009103599B2

(12) United States Patent
Lee et al.

(10) Patent No.: US 9,103,599 B2
(45) Date of Patent: Aug. 11, 2015

(54) FLAKE AND METHOD FOR REDUCING TEMPERATURE OF WASTE HEAT DISCHARGED FROM AIR CONDITIONER

(75) Inventors: Wei-Ching Lee, Taipei (TW); Tzu-I Lee, Taipei (TW); Yu-Jieh Lee, Taipei (TW); Yu-Hsuan Lee, Taipei (TW); Peng-Chieh Lee, Taipei (TW); Po-Chang Lee, Taipei (TW)

(73) Assignee: Wei-Ching Lee, Taipei (TW)

( * ) Notice: Subject to any disclaimer, the term of this patent is extended or adjusted under 35 U.S.C. 154(b) by 384 days.

(21) Appl. No.: 13/598,629

(22) Filed: Aug. 30, 2012

(65) Prior Publication Data

US 2014/0060772 A1 Mar. 6, 2014

(51) Int. Cl.

| | |
|---|---|
| ***F28D 5/00*** | (2006.01) |
| ***F28D 15/00*** | (2006.01) |
| ***F28F 27/00*** | (2006.01) |

(52) U.S. Cl.

CPC ..... *F28D 15/00* (2013.01); *F28F 27/00* (2013.01)

(58) Field of Classification Search

CPC ..... Y02B 30/545; F24F 5/0035; F25B 39/04

USPC ..... 62/304, 478, 498, 506, 507; 165/11.1, 165/104.34

See application file for complete search history.

(56) References Cited

U.S. PATENT DOCUMENTS

| | | | | |
|---|---|---|---|---|
| 5,771,961 | A * | 6/1998 | Alizadeh | 165/121 |
| 2005/0077637 | A1 * | 4/2005 | Mockry et al. | 261/112.1 |

* cited by examiner

*Primary Examiner* — Melvin Jones
(74) *Attorney, Agent, or Firm* — Leong C. Lei

(57) ABSTRACT

The invention provides a flake and method for reducing waste heat using water produced when an air conditioner operates and thereby heat exchange efficiency can increase. Accordingly, an energy-saving effect can be achieved. The flake is placed at an inner bottom side of the air conditioner and between a condenser fan and a condenser coil. When the condenser fan operates, wind power created by the condenser fan has a portion blowing toward the flake, and then blowing toward underlying water, produced when the air conditioner operates, along the flake such that the water can move to the condenser coil and cool the condenser coil. Thereby, the temperature of discharged waste heat can be reduced. When the condenser coil cools, heat exchange efficiency increases. Accordingly, an indoor cooling effect can be improved and an energy-saving effect can be achieved.

8 Claims, 7 Drawing Sheets

FLAKE AND METHOD FOR REDUCING TEMPERATURE OF WASTE HEAT DISCHARGED FROM AIR CONDITIONER

BACKGROUND OF THE DISCLOSURE a) Field of the Disclosure

The invention relates to a flake reducing temperature of waste heat discharged from an air conditioner, and more particularly, to a flake used to reduce temperature of a condenser coil in an air conditioner for the sake of reducing temperature of waste heat discharged from the air conditioner.

b) Brief Description of the Related Art

Technology is continuously advanced and widely used and thus life is made more comfortable. In addition to the positive benefits, the technology also brings negative damage. In recent years, global warming and climate changing brought meteorological disasters at every moment around the world. Thus, attention to environmental issues is gradually paid. Various devices for preventing pollution and saving energy become a mainstream one of product designs.

With regards to an air conditioner, reducing energy consumption is emphasized, but the impact on the environment by hot air discharged from the air conditioner is ignored when we are deeply concerned about the performance of the air conditioner. In a densely populated city, numerous air conditioners expel polluted and hot air that causes serious pollution.

Currently, some air conditioners are provided with fans raising water produced in operation, and thereby the water can be discharged with wind to the outside. However, they have disadvantages that spaces are necessary to be left between the fans and bottoms of the air conditioners and thus the damage of the fans hitting the bottoms can be avoided. In this case, water remains at the bottoms and cannot be discharged. Further, dust is partially collected at the bottoms and cannot be expelled with wind. After a period of time, the dust will be attached to the bottoms and indirectly affects a cooling efficiency.

Accordingly, with regards to a design for an air conditioner, reducing temperature of waste heat has become an important section. Particularly, how emissions of waste heat can be reduced so as to lessen thermal pollution in the environment becomes a major issue in this industry of air conditioners. However, existing air conditioners have not achieved expected effects.

SUMMARY OF THE DISCLOSURE

In order to solve the above problems, the invention provides a method for reducing waste heat using water produced when an air conditioner operates and thereby heat exchange efficiency can increase. Accordingly, an energy-saving effect can be achieved.

In order to achieve the above objectives, the present invention proposes a flake for reducing temperature of waste heat discharged from an air conditioner. The flake is placed at an inner bottom side of the air conditioner and between a condenser fan and a condenser coil. When the condenser fan operates, wind power created by the condenser fan has a portion blowing toward the flake, and then blowing toward underlying water, produced when the air conditioner operates, along the flake such that the water can be raised and then move to the condenser coil so as to cool the condenser coil. Thereby, the temperature of discharged waste heat can be reduced. When the condenser coil cools, heat exchange efficiency increases. Accordingly, an indoor cooling effect can be improved and an energy-saving effect can be achieved. The invention provides the flake that can be placed on any type of air conditioner, suitable for each air conditioner having different specifications on market. The flake has high compatibility and can be launched soon into the market. Further, the water and dust at the bottom can be discharged with wind.

Further, multiple holes are provided in the flake and lead air to flow relatively smoothly.

Further, the flake inclines to the condenser fan such that air pressure, when the wind passes over a surface of the water, can increase and thus dust can be raised.

The flake has a top at a level lower than an axis of the condenser fan.

The present invention further proposes a method for reducing temperature of waste heat discharged from an air conditioner. The method includes placing a flake at an inner bottom side of the air conditioner and between a condenser fan and a condenser coil. When the condenser fan operates, wind created by the condenser fan has a portion moving along the flake and driving water on an inner bottom surface of the air conditioner to move to the condenser coil. Thereby, the temperature of discharged waste heat can be reduced and other advantages as mentioned above can be achieved.

Further, the invention proposes an air conditioner including a housing, a condenser fan, a condenser coil, an evaporator fan, an evaporator coil, a compressor, an expansion valve and a controller. The condenser fan, condenser coil, evaporator fan, evaporator coil, compressor and expansion valve are arranged in the housing. The controller, condenser fan and evaporator fan are electrically connected to the compressor. The condenser coil has an end communicating with the compressor and the other end communicating with the expansion valve. The evaporator coil has an end communicating with the compressor and the other end communicating with the expansion valve. The condenser fan faces the condenser coil. The evaporator fan faces the evaporator coil. A flake is placed at a bottom side of the housing and between the condenser fan and the condenser coil. When the condenser fan operates, wind created by the condenser fan has a portion moving along the flake and driving water on an inner bottom surface of the air conditioner to move to the condenser coil. Thereby, the air conditioner has an improved effect and discharged waste heat can be reduced.

The accompanying drawings are included to provide a further understanding of the invention, and are incorporated as a part of this specification. The drawings illustrate embodiments of the invention and, together with the description, serve to explain the principles of the invention.

BRIEF DESCRIPTION OF THE DRAWINGS

The drawings disclose illustrative embodiments of the present disclosure. They do not set forth all embodiments. Other embodiments may be used in addition or instead. Details that may be apparent or unnecessary may be omitted to save space or for more effective illustration. Conversely, some embodiments may be practiced without all of the details that are disclosed. When the same numeral appears in different drawings, it refers to the same or like components or steps.

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure.

Figure 1:
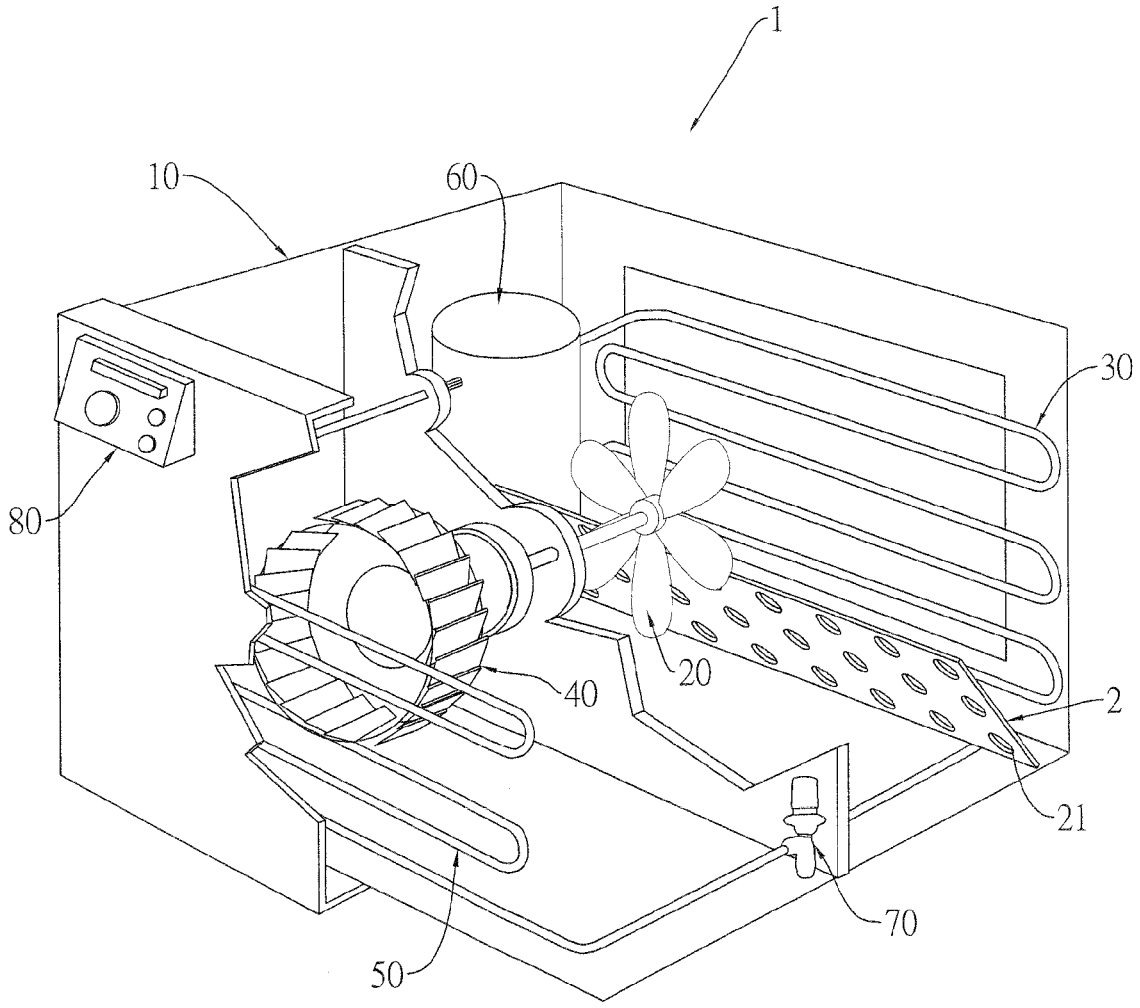
FIG. 1 is a three-dimensional view of an air conditioner in accordance with an embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

In order to make the embodiment easy to be understood, the present invention "FLAKE AND METHOD FOR REDUCING TEMPERATURE OF WASTE HEAT DISCHARGED FROM AIR CONDITIONER" is illustrated in combination with an air conditioner. However, the scope of the invention is limited solely by the claims.

The embodiment proposes a method for reducing temperature of waste heat discharged from an air conditioner. The method includes placing a flake 2 at an inner bottom side of the air conditioner 1 and between a condenser fan 20 and a condenser coil 30. When the condenser fan 20 operates, wind created by the condenser fan 20 has a portion moving along the flake 2 and driving water on an inner bottom surface of the air conditioner 1 to move to the condenser coil 30.

In the following, an arrangement of the flake 2 combined in the air conditioner 1 illustrates the flake 2 and the effects and functions of the above method.

FIG. 1 is a three-dimensional view of an air conditioner in accordance with an embodiment of the present invention. The air conditioner 1 includes a housing 10, a condenser fan 20, a condenser coil 30, an evaporator fan 40, an evaporator coil 50, a compressor 60, an expansion valve 70 and a controller 80.

The condenser fan 20, condenser coil 30, evaporator fan 40, evaporator coil 50, compressor 60 and expansion valve 70 are arranged in the housing 10. The controller 80, condenser fan 20 and evaporator fan 40 are electrically connected to the compressor 60. The condenser coil 30 has an end communicating with the compressor 60 and the other end communicating with the expansion valve 70. The evaporator coil 50 has an end communicating with the compressor 60 and the other end communicating with the expansion valve 70. The condenser fan 20 faces the condenser coil 30. The evaporator fan 40 faces the evaporator coil 50.

Figure 2:
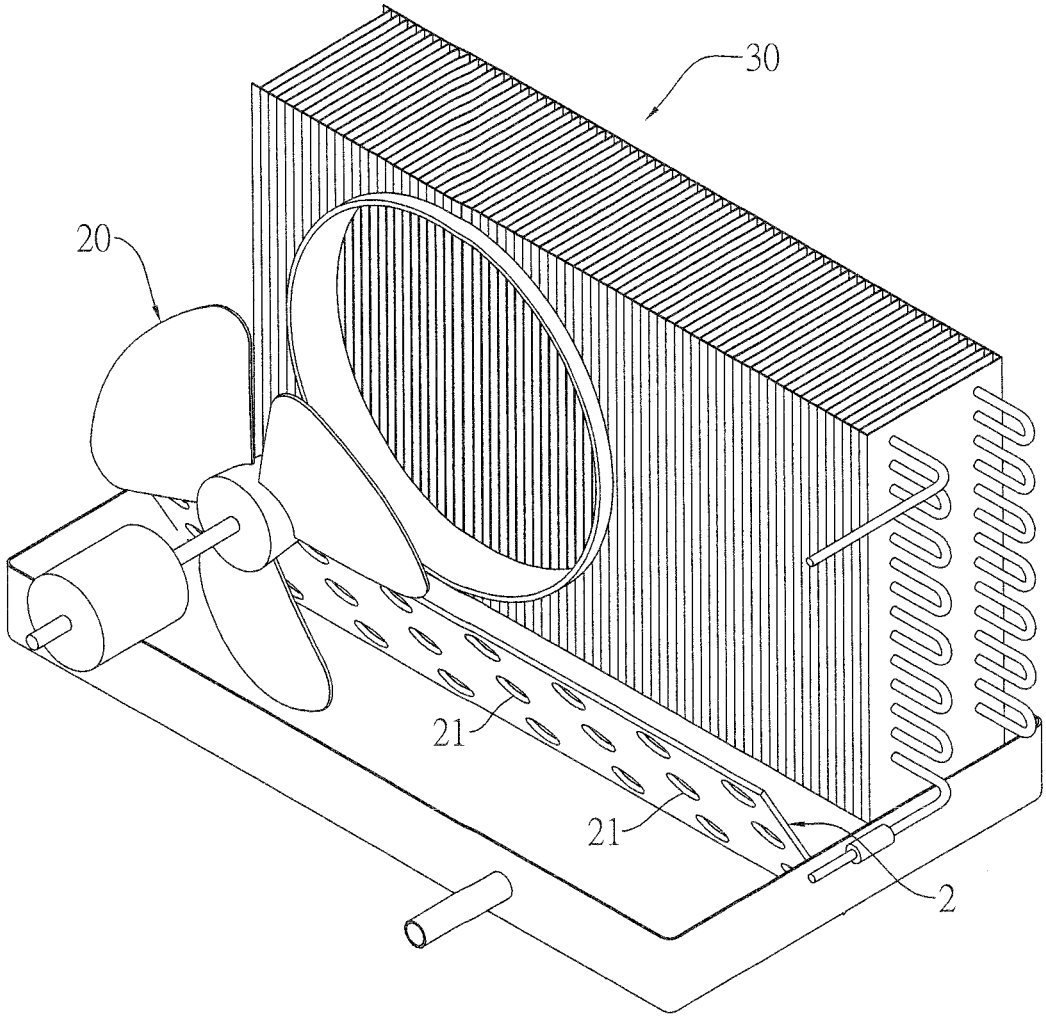
FIG. 2 is a three-dimensional partial view in accordance with an embodiment of the present invention.
Figure 3:
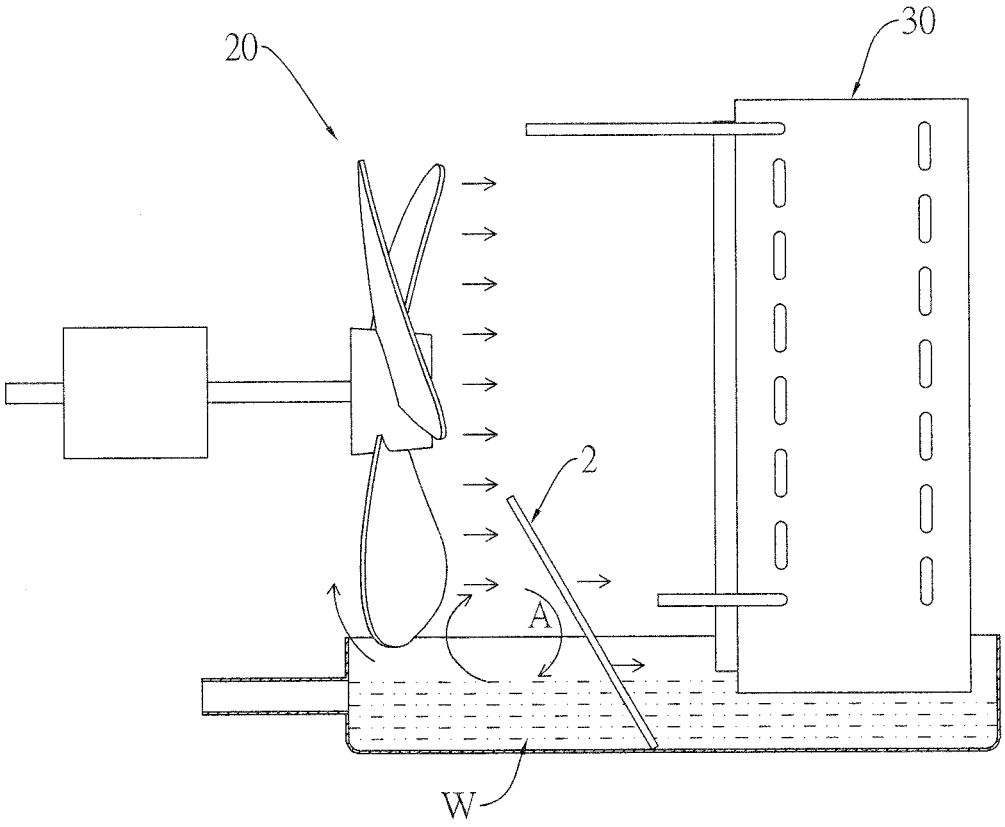
FIG. 3 is a side partial view in accordance with an embodiment of the present invention.

Referring to FIGS. 2 and 3, a flake 2 is placed at a bottom side of the housing 10 and between the condenser fan 20 and the condenser coil 30. When the condenser fan 20 operates, wind created by the condenser fan 20 has a portion moving along the flake 2, as seen in an arrow A, and driving water W on an inner bottom surface of the air conditioner 1 to move to the condenser coil 30. Thereby, the condenser coil 30 can be further cooled and thus discharged air is not so hot. Further, the flake 2 is not affected by a size of the condenser fan 20. Water and dust at the bottom of the housing 10 can be raised by wind power created by the condenser fan 20. Thereby, water can be efficiently used for cooling and dust expelling. It is convenient for a cleaning process in the future.

Figure 4:
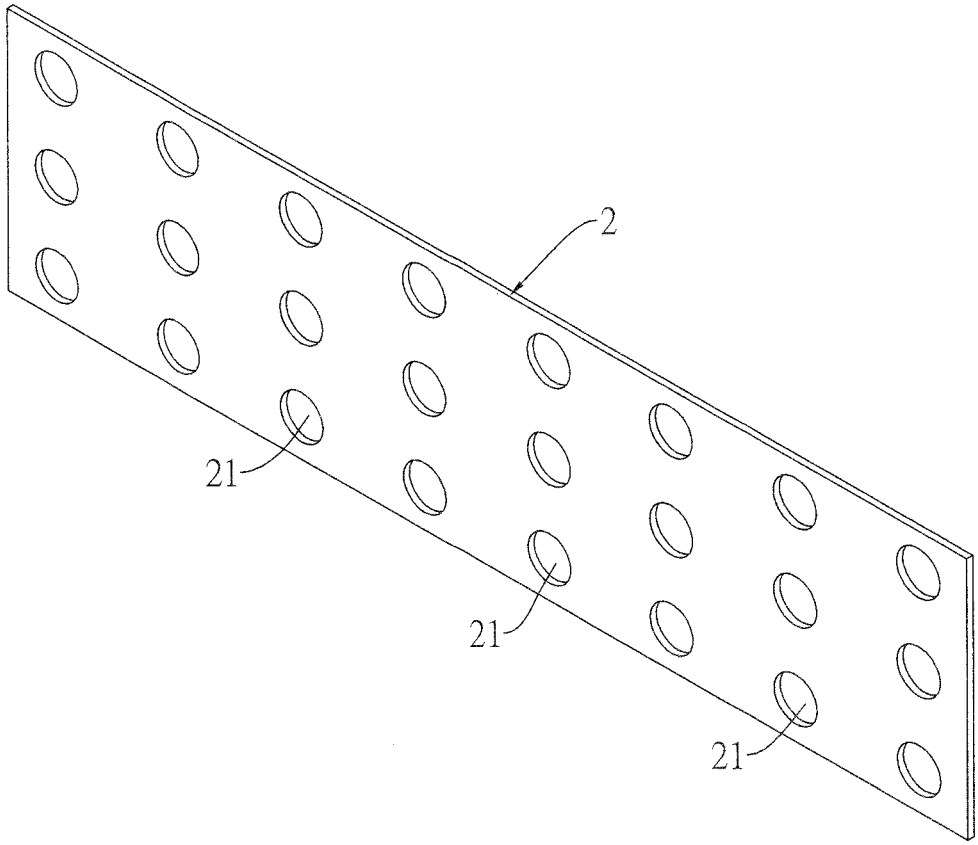
FIG. 4 is a three-dimensional view of a flake in accordance with an embodiment of the present invention.

Referring to FIG. 4, multiple holes 21 are provided in the flake 2 and lead air to flow relatively smoothly.

Further, referring to FIGS. 1-3, the flake 2 inclines to the condenser fan 20 such that wind power can be guided to press a surface of the water and thus the water can splash with the wind.

Further, the flake 2 has a top at a level lower than an axis of the condenser fan 20.

Besides, the flake 2 can connect with two sides of the housing 10 and can be close to a bottom of the housing 10, which is in the scope of "at an inner bottom side of the air conditioner" as claimed in claims.

Figure 5:
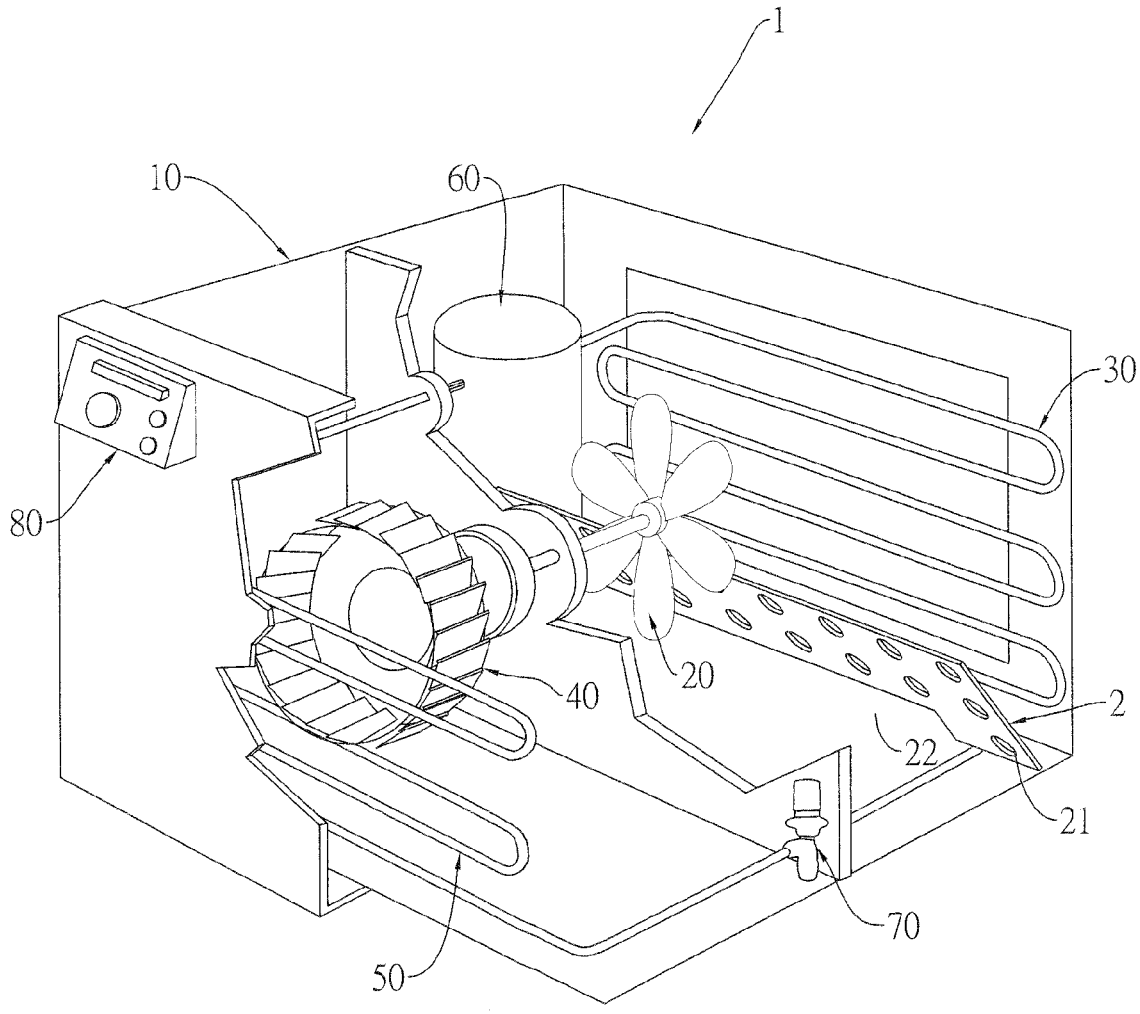
FIG. 5 is a three-dimensional view of an air conditioner having a flake provided with a longitudinal hole in accordance with an embodiment of the present invention.
Figure 6:
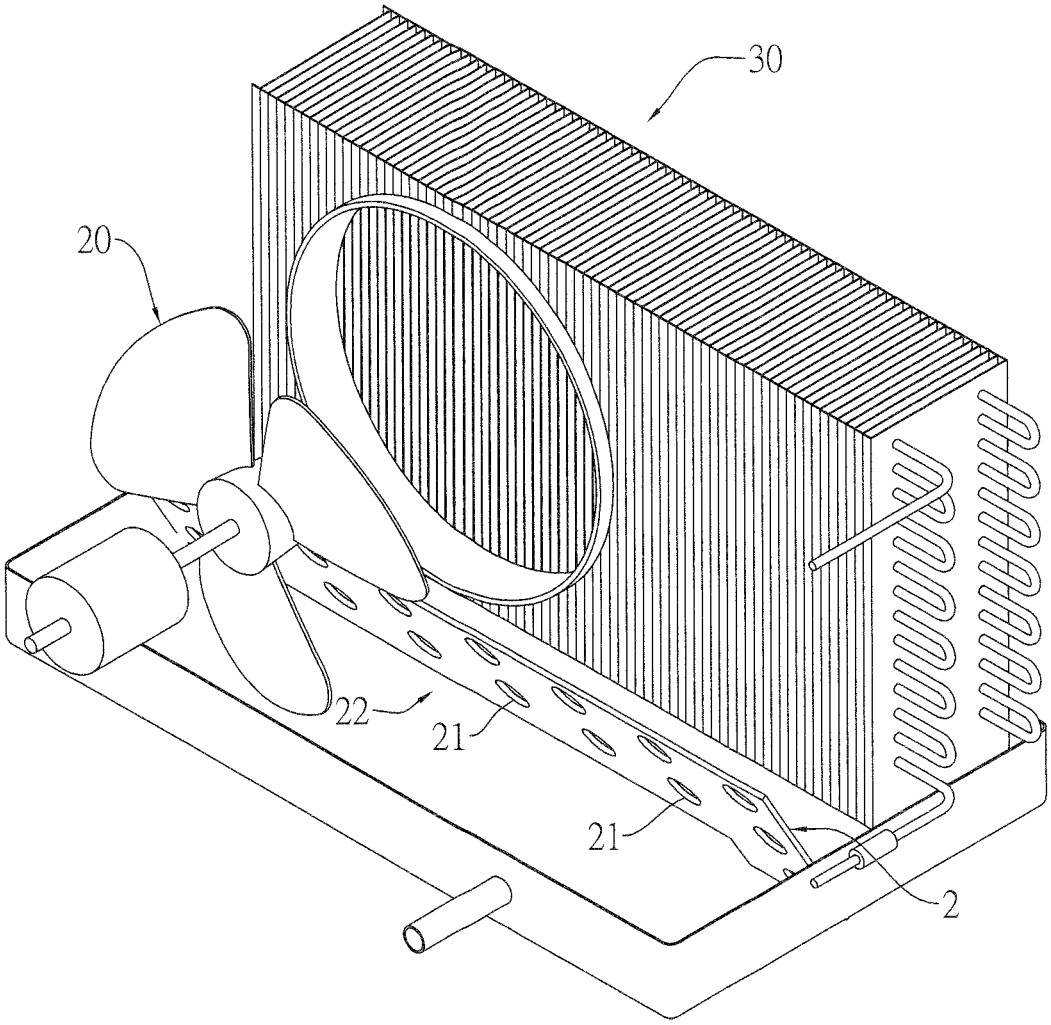
FIG. 6 is a three-dimensional partial view showing a flake provided with a longitudinal hole in accordance with an embodiment of the present invention.
Figure 7:
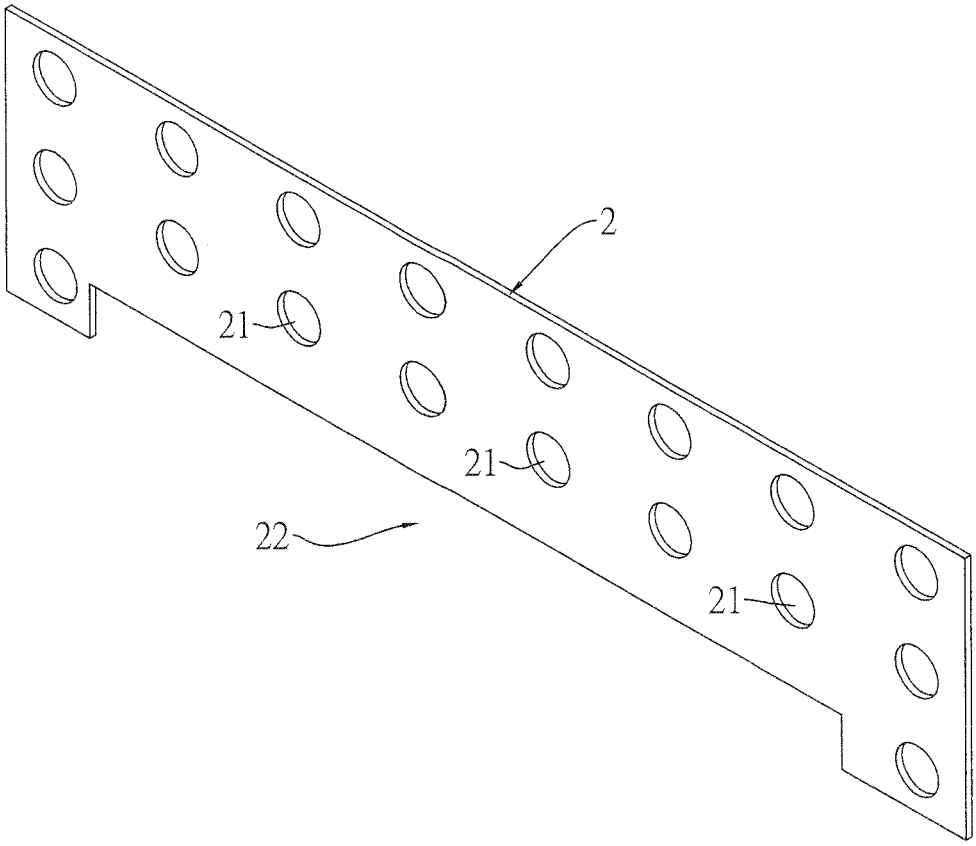
FIG. 7 is a three-dimensional view of a flake provided with a longitudinal hole in accordance with an embodiment of the present invention.

Referring to FIGS. 5-7, a longitudinal hole 22 can be provided at a bottom of the flake 2 and leads air to flow therethrough. Thereby, increased water can be raised with the air flowing and the condenser coil 30 can further cool.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A flake reducing temperature of waste heat discharged from an air conditioner is configured to be provided at an inner bottom side of the air conditioner and between a condenser fan and a condenser coil, wherein multiple holes are in the flake, and the flake is configured to incline to the condenser fan and have a top at a level lower than an axis of the condenser fan.

2. The flake of claim 1, wherein a longitudinal hole is at a bottom of the flake.

3. A method for reducing temperature of waste heat discharged from an air conditioner, comprising providing a flake at an inner bottom side of the air conditioner and between a condenser fan and a condenser coil, wherein when the condenser fan operates, wind created by the condenser fan has a portion moving along the flake and driving water on an inner bottom surface of the air conditioner to move to the condenser coil.

4. The method of claim 3, wherein multiple holes are in the flake.

5. The method of claim 4, wherein the flake inclines to the condenser fan and has a top at a level lower than an axis of the condenser fan.

6. The method of claim 5, wherein a longitudinal hole is at a bottom of the flake.

7. An air conditioner comprising a housing, a condenser fan, a condenser coil, an evaporator fan, an evaporator coil, a compressor, an expansion valve and a controller, wherein the condenser fan, condenser coil, evaporator fan, evaporator coil, compressor and expansion valve are in the housing, wherein the controller, condenser fan and evaporator fan are electrically connected to the compressor, wherein the condenser coil has an end communicating with the compressor and the other end communicating with the expansion valve, wherein the evaporator coil has an end communicating with the compressor and the other end communicating with the expansion valve, wherein the condenser fan faces the condenser coil, wherein the evaporator fan faces the evaporator coil, characterized in that:

a flake is at a bottom side of the housing and between the condenser fan and the condenser coil, wherein when the condenser fan operates, wind created by the condenser fan has a portion moving along the flake and driving water on an inner bottom surface of the air conditioner to move to the condenser coil.

8. The air conditioner of claim 7, wherein multiple holes are in the flake, wherein the flake inclines to the condenser fan and has a top at a level lower than an axis of the condenser fan, wherein a longitudinal hole is at a bottom of the flake.

* * * * *